United States Patent [19]

Yahashi

[11] Patent Number: 4,842,144

[45] Date of Patent: Jun. 27, 1989

[54] GRAIN SORTER FOR USE IN A ROTARY TYPE RICE HULLING AND SORTING DEVICE

[75] Inventor: Satoru Yahashi, Nangoku, Japan

[73] Assignees: Seirei Industry Company Limited, Okayama; Yanma Agricultural Equipment Company Limited, Osaka, both of Japan

[21] Appl. No.: 460,990

[22] Filed: Jan. 25, 1983

[30] Foreign Application Priority Data

Jan. 28, 1982 [JP] Japan ..... 57-10926[U]

[51] Int. Cl.[4] ..... B07B 13/04

[52] U.S. Cl. ..... 209/44.1; 99/621; 209/687

[58] Field of Search ..... 209/687, 684, 44.3, 209/689, 690, 44.1–44.2; 241/6.9, 10, 11; 99/621

[56] References Cited

U.S. PATENT DOCUMENTS 2,182,638 12/1939 Mjolsness ..... 209/687
2,191,843 2/1940 Bloc ..... 209/687
2,672,233 3/1954 Freeman ..... 209/687
4,392,421 7/1983 Yano et al. ..... 209/687
4,415,088 11/1983 Yano et al. ..... 209/687
4,441,412 4/1984 Imamura et al. ..... 209/687

*Primary Examiner*—Robert B. Reeves
*Assistant Examiner*—Donald T. Hajeg
*Attorney, Agent, or Firm*—Fisher, Christen & Sabol

[57] ABSTRACT

A grain sorter for use in a rotary type rice hulling and sorting device comprising a hulling part, a pneumatical sorting part, sorting cylinders rotatably installed so that mixed rice grains may be fed from one end and the sorter rice grains may be discharged from the other end. The sorting cylinders have a large number of recesses formed on their internal surface and troughs for taking out the sorted rice grains received by the recesses which are installed inside the sorting cylinder. The troughs consist of (1) a plurality of troughs for taking out finished sorted rice grains of the sorted rice grains received by the recesses and (2) a plurality of troughs for taking out sorted rice grains, which must be sorted again, of the sorted rice grains received by the recesses.

3 Claims, 5 Drawing Sheets

GRAIN SORTER FOR USE IN A ROTARY TYPE RICE HULLING AND SORTING DEVICE

SUMMARY OF THE INVENTION

The present invention relates to an improved rotary type grain sorter for use in a rotary type rice hulling and sorting device comprising a hulling part, a pneumatical sorting part, sorting cylinders rotatably installed so that mixed rice grains may be fed from one end and the sorted rice grains may be discharged from the other end. The sorting cylinders have a large number of recesses formed on their inside peripheral surface. A rotary type sorting part has troughs for taking out sorted rice grains received by the recesses which are installed inside the sorting cylinders.

This device has numerous improvements which include (1) troughs for taking out sorted rice grains that consist of a plurality or group of troughs for taking out finished sorted rice grains of the sorted rice grains received by the recesses and (2) a plurality of troughs for taking out sorted rice grains, which must be sorted again, of the sorted rice grains received by the recesses. The rotary type sorting part includes a plurality of sorting cylinders and a plurality of troughs which are installed in the primary sorting cylinders and which are used in the former process of the rotary type sorting part so that finished sorted rice grains may be discharged outside of machine. Simultaneously, sorted rice grains, which must be sorted again, may be fed into the secondary sorting cylinders which are used in the later process of the rotary type sorting part. The finished sorted rice grains sorted in the primary sorting cylinders are joined with the sorted rice grains, which must be sorted again in the secondary sorting cylinders, through a rice grain-sorting machine.

The first object of the present invention is to provide a grain sorter for use in a rotary type rice hulling and sorting device in which the constituent members are collectively arranged to remarkably increase the sorting capacity. This allows the treatment capacity of a rotary type rice hulling and sorting device to be increased.

The second object of the present invention is to make the grain sorter for achieving the first object of the present invention simple in construction and inexpensive.

BRIEF DESCRIPTION OF THE DRAWINGS

The annexed drawings show an embodiment of the present invention, wherein.

DETAILED DESCRIPTION

Figure 1:
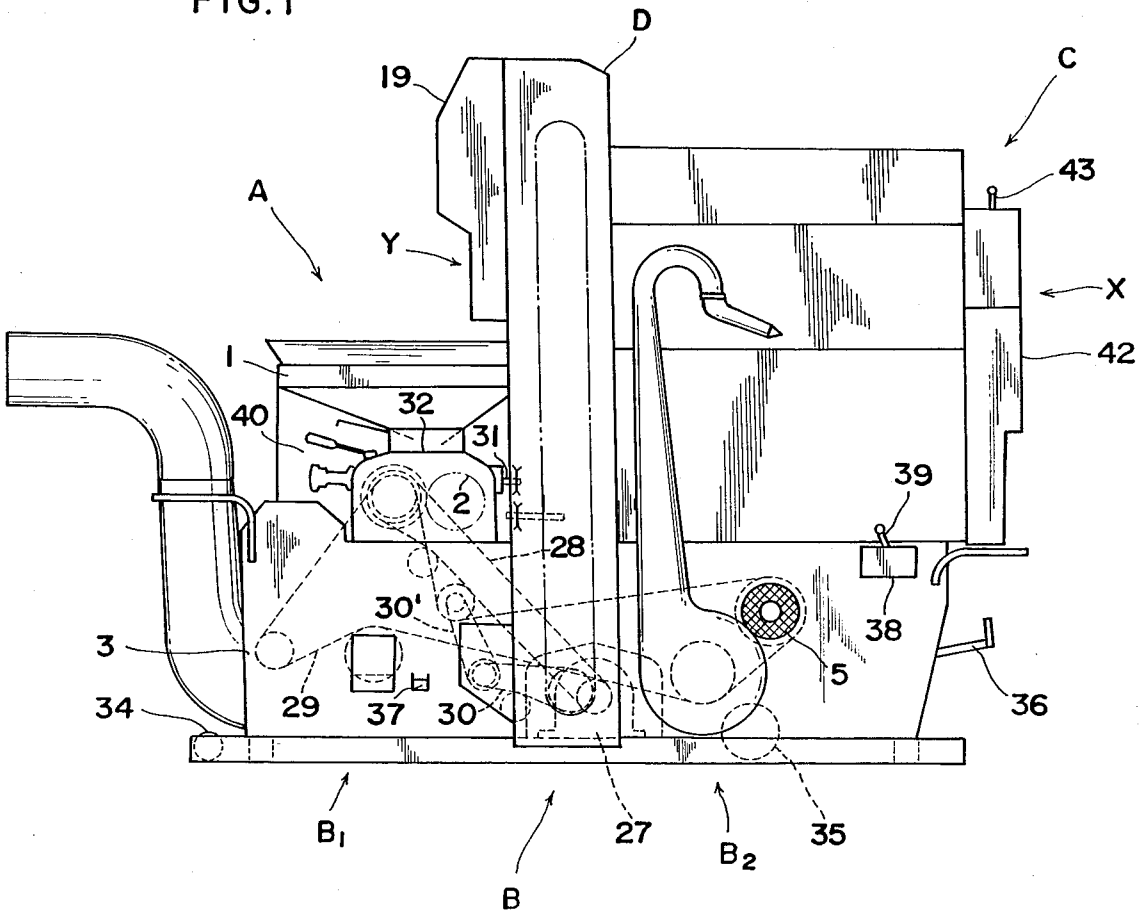
FIG. 1 is a side elevation of a rice hulling and sorting device.
Figure 2:
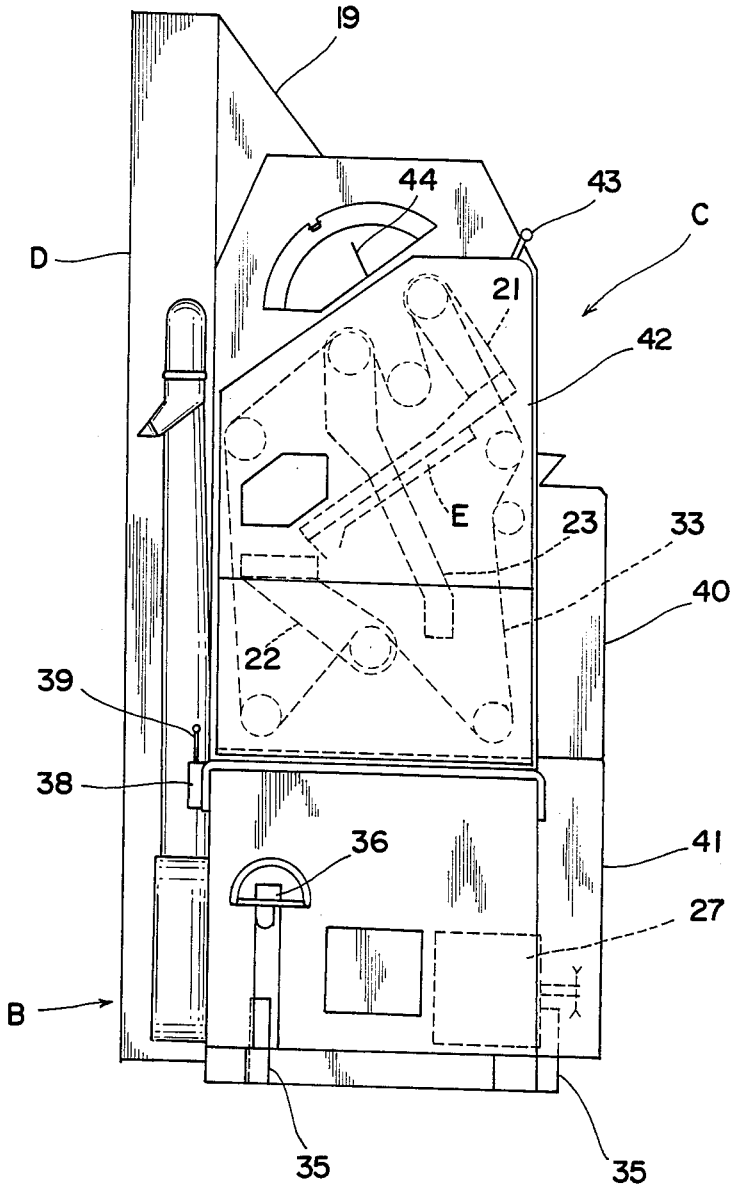
FIG. 2 is a rear view of the device.
Figure 3:
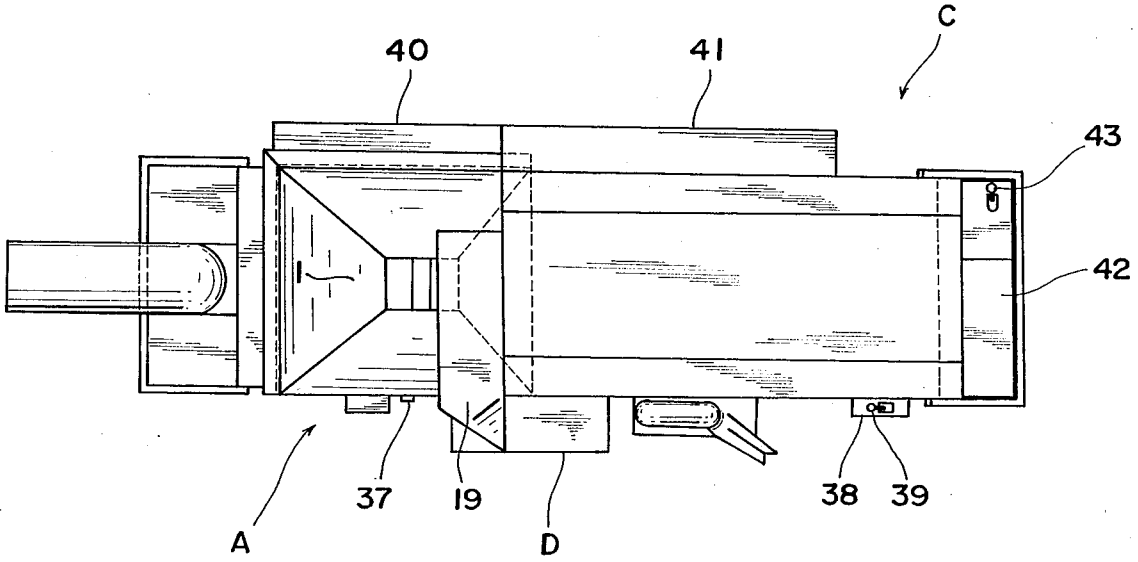
FIG. 3 is a plan view of the device.

A description of an embodiment of the present invention will be made by referring to the drawings.

The letter A designates a hulling part including an unhulled rice-tank and a pair of hulling rolls installed therein. The letter B designates a pneumatic sorting part composed of a hulled rice-pneumatic sorting part B1 and an unhulled rice sorting part B2. B1 is provided with a suction means 3 at its front end to form a suction duct 4. Unhulled-rice sorting part B2 is provided with a pneumatic rice reservoir 5 at its rear end to form a pneumatic duct 6 communicating with B1 so that suction air and pressurized air of the suction means 3 and the pneumatic rice reservoir 5 respectively may be transferred through the suction duct 4 from a pressurized air duct 6. The suction duct 4 has the same width as that of the pressurized air duct 6.

The numeral 7 designates a trough for receiving hulled rice grains, the numeral 8 designates a trough for receiving the second grade hulled rice grains, the numeral 9 designates a trough for receiving unhulled rice grains, the numeral 10 designates a hulling rate-checking valve, which can be freely opened and closed for taking out hulled rice grains pneumatically sorted in the suction duct 4 to check the hulling state thereof, and 11 designates an airflow-adjusting valve for adjusting the suction air in the suction duct 4 and the blowing air from the suction means 3.

The letter C designates a rotary type sorting part comprising a plurality of the primary sorting cylinders "a" and a plurality of the secondary sorting cylinders "b" rotatably installed by means of several rotary wheels 13 and having a large number of recesses 12 formed on their internal surface. This arrangement is so that one side thereof adjacent to the hulling part A may be the discharging side Y and its opposite side may be the feeding side X. The hulling part A is mounted on the hulled rice-pneumatic sorting part B1 and the rotary type sorting part C is mounted on the unhulled-rice sorting part B2.

Figure 5:
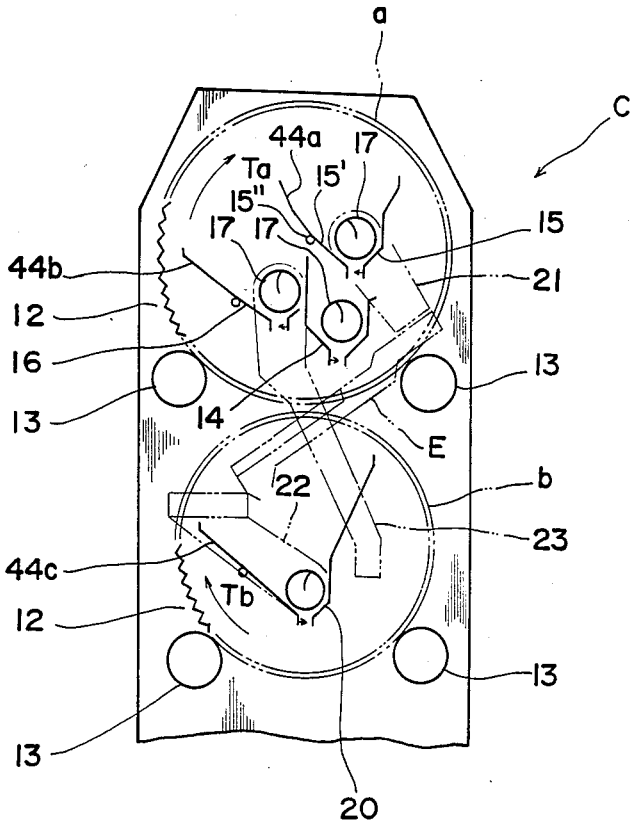
FIG. 5 is a rear view showing the inside structure of the device.

A hulled rice-feeding trough 14, a finished sorted rice-receiving trough 15, and a trough 16 for receiving rice grain to be resorted extend in parallel inside the primary sorting cylinder "a" from the feeding side X to the discharging side Y. Each trough 14, 15, 16 includes a screw conveyor 17. The rice grain to be resorted-receiving trough 16 is arranged in the lower part of the direction of rotation the primary sorting cylinder "a" (shown by an arrow Ta in FIG. 5). The finished sorted rice-receiving trough 15 is arranged in the upper part of the direction of rotation of the primary sorting cylinder "a" (shown by the arrow Ta). The hulled rice-feeding trough 14 is arranged below the finished sorted rice-receiving trough 15 between the rice grain to be resorted-receiving trough 16 and the finished sorted rice-receiving trough 15. The upper portions of the rice grain to be resorted-receiving trough 16 and the finished sorted rice-receiving trough 15 are opened with an angle of elevation all over the length thereof so that rice grains, which are scooped up by the recesses 12 with the rotation of the primary sorting cylinder "a", travel in free fall in a parabolic path. The rice grains may be received just on the troughs 15, 16, and the hulled rice-feeding trough 14 which are provided with a feeding part 18 at the feeding side X thereof.

The numeral 19 designates a hulled rice grain-receiving tank arranged at the discharging side Y of said rotary type sorting part C above an unhulled rice-tank 1. The upper part of the unhulled rice tank 1 communicates with the upper part of a grain hoist D and the lower part communicates with the starting end portion of the hulled rice-feeding trough 14. The lower part of the grain hoist D communicates with the trough for receiving hulled rice grains of the pneumatic sorting part B to form a passage for conveying unhulled rice from the pneumatic sorting part B to the inside of the primary sorting cylinder "a".

A resorted rice grain-receiving trough 20 includes a screw conveyor which extends inside the secondary sorting cylinder "b" from the feeding side X to the discharging side Y similarly to the case of the primary sorting cylinder "a". It is opened with an angle of elevation all over the length thereof similarly to the case of the finished sorted rice-receiving trough 15.

The letter E designates a rice grain sorter using longitudinal lines and installed aslant at the feeding side X of the rotary type sorting part C. Its upper portion is in communication with the end portion of the finished sorted rice-receiving trough 15 through a discharging pipe 21. Its lower portion is in communication with the starting end portion of the resorted rice grain-receiving trough 20 installed in the secondary sorting cylinder "b" through a receiving pipe 22. Small sorted rice grains received by the finished sorted rice-receiving trough 15 are removed during their passage toward the resorted rice grain-receiving trough 20. In addition, these removed small grains are discharged outside of the machine from the side portion of the cover 42 which is described below.

A resorted rice grain-receiving trough 16 installed in the primary sorting cylinder "a" communicates with the inside of the secondary sorting cylinder "b" at the end portion thereof through a feeding pipe 23 the lower portion of which is inserted into the feeding sides X of the secondary sorting cylinder b. This is to form a passage for feeding the mixture of hulled rice and some unhulled rice. This is so that sorted rice grains received by the resorted rice grain-receiving trough 16 may be resorted.

The discharging side Y of the primary sorting cylinder a is disposed over the unhulled rice tank 1. The discharging side Y of the secondary sorting cylinder "b" communicates with the trough for receiving hulled rice grains 7 through a return plate 24 which is installed aslant. The end portion of the resorted rice grain-receiving trough 20 communicates with a flow-down plate 26 which is installed aslant against the unhulled-rice sorting part B2 through a passage 25. The trough for receiving hulled rice 7 communicates with a thrower for taking out hulled rice to the outside of the body of the device or machine. Therefore, the passage for taking out hulled rice to the outside of the body of the machine is formed through the finished sorted rice-receiving trough 15, the rice grain sorter E, the resorted rice grain-receiving trough 20, and the hulled rice-pneumatic sorting part B2 in this order.

The numeral 27 designates a prime mover installed in the space below the pressurized air duct 6, the numeral 28 designates a V-belt laid around a pulley of an axis of the fixed hulling roll of a pair of hulling rolls 2 of the hulling part A and a pulley of the prime mover 27, the numeral 29 designates a V-belt for interlocking an axis of the fixed hulling roll, an axis of the suction means 3 and axis of screw conveyors installed in the trough for receiving the second grade hulled rice grains 8, the trough for receiving hulled rice grains 7 and the trough for receiving unhulled rice grains 9. The numeral 30 designates a V-belt for revolving a bucket belt of the grain hoist D through the trough for receiving hulled rice grains 7. The numeral 31 designates a driving shaft for driving the rotary type sorting part C which rearwardly protrudes from a gear box 32 in the direction meeting at right angles to an axis of the hulling roll 2 by means of a bevel gear included in the gear box 32. Power is transmitted by a belt from the driving shaft 31 to the discharging side Y of the rotary wheel 13 supporting the secondary sorting cylinder "b".

The numeral 33 designates a V-belt for interlocking an axis of the rotary wheel 13 which supports the secondary sorting cylinder "b". An axis of the rotary wheel 13 supports the primary sorting cylinder "a". The axes of the screw conveyors 17 are along the rice grain to be resorted-receiving trough 16, the hulled rice-feeding trough 14, and the finished sorted rice-receiving trough 15. An axis of the screw conveyor of the resorted rice grain-receiving trough 20 is at the feeding side X of the rotary type sorting part C.

The numerals 34 and 35 designate movable wheels mounted at the front end and the rear portion of a stand of the machine, both of which are constructed so as to freely appear in and disappear from the space below a stand of the machine. The rear movable wheels 35 are provided on both sides of the body so that the body may be moved up and down by the up and down movement of a lever 36.

The numeral 37 designates an opening which communicates the hulling rate-checking valve 10 with the body. The numeral 38 designates a speed change box installed at the left side of the body. The rotational frequency of each axis of the rotary type sorting part C can be freely changed. This is done by making the effective diameter of a split pulley freely changeable by placing tension on a belt with the pulley for driving a belt provided on the driving shaft 31 that rearwardly protrudes from the gear box 32 on an axis of the rotary wheel 13 of the secondary sorting cylinder "b". The split pulley through the tension pulley changes the tension of the belt by operating the speed change lever 39 of the speed change box 38. Detail description is omitted.

The numerals 40 and 41 are covers for a driving device of each of the V-belts 28, 29, and 30 installed at the right side of the hulling part A and the pneumatic sorting part B, respectively. The numeral 42 designates a cover for the V-belt 35 which interlocks axes of the rotary type sorting part C, the rice grain sorter E, and the like.

The bottoms of the hulled rice-feeding trough 14, the finished sorted rice-receiving trough 15, the rice grain to be resorted-receiving trough 16, and the resorted rice grain-receiving trough 20 are constructed so as to be freely opened and closed all along their length. They can be interlocked by using an operating lever 43 arranged at the feeding side X through a link and a coupling rod.

The operation of a grain sorter according to the present invention having the above described structure is described below.

The power is transmitted from the prime mover 27 to the hulling part A, the pneumatic sorting part B, and the grain hoist D through V-belts 28, 29, 30, and 30'. The power simultaneously revolves the rotary type sorting part C through the driving shaft 31.

Unhulled rice grains fed into the unhulled rice-tank 1 are hulled by a pair of hulling rolls 2. They are then pneumatically sorted in the suction duct 4. The second grade rice grains, husks, and dusts are removed, collected, and transferred to the left side of the body. They are then hoisted into the hulled rice grain-receiving tank 19 by the grain hoist D. In this case, the hulling rate-checking valve 10 is opened to take out hulled rice grains from the opening 37 in order to check the hulling state.

The hoisted hulled rice grains (mixture of unhulled rice grains and husks) are transferred inside the primary sorting trough "a" rearwardly from the lower portion of the hulled rice grain-receiving tank 19 to the feeding port 18. From here the hulled rice grains are dropped onto the inside peripheral surface of the primary sorting cylinder "a".

The dropped mixture of rice grains is scooped up by the recesses 12 with the revolution of the primary sorting cylinder "a" in the direction of the arrow Ta. The dropped mixture of rice grains is piled up as it is dropped from the feeding port 18. The mixture is gradually shifted toward the direction of revolution of the primary sorting cylinder "a" to travel from the feeding side X to the discharging side Y. During the transfer of the dropped mixture of rice grains from the feeding side X to the discharging side Y, the mixture is sorted depending upon the grain size and their lubricity. The unhulled-rice grains sink into the lower layer while the husks rise to the upper layer. The unhulled-rice grains, that are scooped by the recess 12, are upwardly hoisted to the upper side where they escape from the recesses 12 and drop onto the finished sorted rice-receiving trough 15 or the rice grain to be resorted-receiving trough 16 along a parabolic path.

The husks rise to the upper layer, but they are not easily caught in the recess 12 because of their small grain sizes. Even when they are caught in the recesses 12, they cannot usually reach the finished sorted rice-receiving trough 15 and those which do reach the finished sorted rice-receiving trough 15 drop onto the rice grain to be resorted-receiving trough 16. This is because they have large grain sizes and the unhulled-rice grains, which have small grain sizes, are deeply caught in the recesses 12 and have difficulty escaping therefrom. The unhulled-rice grains are hoisted to the uppermost position and then reach the inside of the finished sorted rice receiving trough 15.

The husks and the unhulled-rice grains, which were not caught in the recesses 12 and could not reach the inside of the rice grain to be resorted-receiving trough 16, flow repeatedly in breaking style in the direction opposite to the direction Ta and transfer toward the discharge side Y.

The unhulled-rice grains which have normal or small grain sizes are scooped up on the finished sorted rice-receiving trough 15 while the mixture of unhulled-rice, which contains some husks, are scooped up on the rice grain to be resorted-receiving trough 16. The unhulled-rice grains received on the finished sorted rice-receiving trough 15 are rearwardly transferred by a screw conveyor 17 to the end portion of the trough 15. From here they go to the rice grain sorter E through the discharging pipe 21 where those having small grain sizes escape. The escaping unhulled-rice grains are taken out of the body through the cover 42 while the remaining unhulled rice grains with normal grain sizes are thrown into the resorted rice grain-receiving trough 20 through the receiving pipe 22 to join with the unhulled-rice grains scooped up by the recesses 12 of the secondary sorting cylinder "b" which is described below.

The mixture of unhulled-rice grains received on the rice grain to be resorted-receiving trough 16 are rearwardly transferred in a similar manner. They are fed on the inside peripheral surface of the feeding side X of the cylinder "b" and the feeding pipe 23.

The fed mixture of unhulled-rice grains is repeatedly subjected to a sorting action. This action comprises scooping up the mixture with the recesses 12 that revolve in the direction shown by the arrow Tb in FIG. 5. This revolving is in the same direction as the primary sorting cylinder "a".

Figure 4:
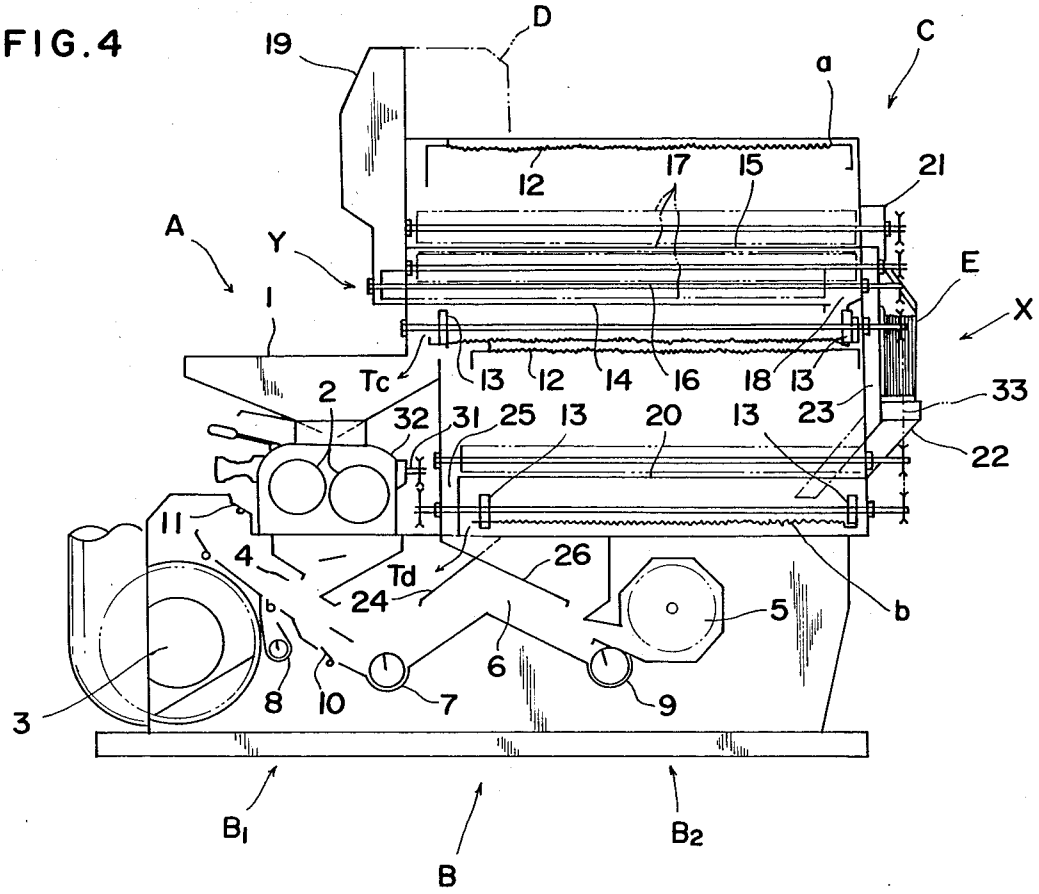
FIG. 4 is a side elevation showing the internal structure of the device.

The scooping up action by the recesses 12 of the primary sorting cylinder "a" is performed carried so that only husks may be returned to the unhulled-rice tank 1 from the discharging side Y of the cylinder "a". This is shown by an arrow Tc in FIG. 4. Resorting occurs while the scooping up action by the recesses 12 of the secondary sorting cylinder "b" is performed. This is so that only unhulled-rice grains may be dropped on the resorted rice grain-receiving trough 20. Thus, some husks and the mixture of unhulled-rice grains are discharged from the discharging side Y end of the secondary sorting cylinder "b" and then thrown down on the return plate 24 as shown by an arrow Td in FIG. 4. After resorted pneumatically, hulled rice grains are dropped on the trough for receiving hulled rice grains 7 and join the fresh hulled rice grains. Unhulled-rice grains received on the resorted rice grain-receiving trough 20 are transferred to the pressurized air duct 6 through the passage 25 and the flow-down plate 26. Here they are pneumatically sorted and collected in the trough for receiving unhulled rice grains 9. They are then transferred sideways and taken out to the appointed place by a thrower.

Adjustments can be made by a controlling plate 44, which has an adjustable tilting attitude, adjustably installed at the feeding side of each trough. This also adjusts of the strength of the scooping up action of the recesses 12. This is accomplished by the alteration of the rotational frequency of the the rotary type sorting part C by operating the speed change lever 39. This is carried out in order to make the desired unhulled-rice grains drop on the finished sorted rice-receiving trough 15, the rice grain to be resorted-receiving trough 16, and the resorted rice grain-receiving trough 20 as described above.

After the completion of the operation, the bottom portions of all troughs are simultaneously opened over their entire length. This is done by an operating lever 43. The remaining grains flowing through the rotary type sorting part C are dropped on the inside peripheral surface of each sorting cylinder "a" and "b". Simultaneously the rear portion of the body is being raised. The body is titled to accelerate the forward transfer of the remaining grains. This is followed by their being discharged from the discharging side Y of the sorting cylinder "a" and "b" in order to remove the remaining grains from the rotary type sorting part C.

The transfer of grains may be accelerated by making the attitude of the sorting cylinders "a" and "b" such that the discharging side Y slightly lower than the feeding side X.

As described above a grain sorter according to the present invention for use in a rotary type rice hulling and sorting device comprises a hulling part, a pneumatical sorting part, sorting cylinders rotatably installed so that mixed rice grains may be fed from one end and the sorted rice grains may be discharged from the other end. They cylinders have a large number of recesses formed on their inside peripheral surface and troughs for taking out the sorted rice grains received by the recesses which are installed inside said sorting cylinder. The troughs consist of (1) a trough for taking out finished sorted rice grains of the sorted rice grains received by the recesses and (2) a trough for taking out sorted rice grains, which must be sorted again, of the sorted rice grains received by the recesses. As shown in the preferred embodiment, the single sorting cylinder can stepwise divide unhulled-rice grains into three kinds of grains. The three kinds of grains are (1) finished sorted rice grains consisting of unhulled-rice grains having the normal grain sizes and unhulled-rice grains having small grain sizes, (2) resorted grains of unhulled-rice containing some husks, and (3) husks, which cannot be scooped up by the recesses on the troughs.

The finished sorted grains (unhulled-rice grains having the normal grain sizes and small grain sizes) sorted by the primary sorting cylinder and received on a finished sorted rice grain-receiving trough are not resorted in the secondary sorting cylinder. The grains to be resorted (unhulled-rice grains containing some husks), which are received on a rice grain to be resorted-receiving trough, are resorted in the secondary sorting cylinder. This reduces the load against the secondary sorting cylinder and as a result it can be miniaturized and the duplicated use of an unhulled-rice grain-taking out means can be avoided. This is because a plurality of sorting cylinders are installed in the rotary type sorting part. A plurality of the receiving troughs are installed in the primary sorting cylinder, which is used as the former process of the rotary type sorting part, to take finished sorted rice grains out of the body of machine. Simultaneously rice grains to be resorted are sorted in the secondary sorting cylinder which is used as the latter process of the rotary type sorting part.

The unhulled-rice grains having small grain sizes are sorted in preference to the unhulled-rice grains having the normal grain sizes and husks in the primary sorting cylinder. They are then taken out as finished sorted rice grains together with the unhulled-rice grains having the normal grain sizes. After this they are removed from the body of the machine by a rice grain sorter. The unhulled-rice grains include the normal grain sizes from which the dust is completely removed and can be obtained without blowing the unhulled-rice grains having small sizes out of the body of machine. This is true even though the force of the wind in the pressurized air duct of the pneumatic sorting part is increased to some extent because finished sorted rice grains (unhulled-rice grains having the normal grain sizes and small grain sizes) sorted in the primary sorting cylinder are transferred through the rice grain sorter to the secondary sorting cylinder where they are joined with the grains to be sorted again.

What is claimed is:

1. A grain sorter for use in a rotary type rice hulling and sorting device comprising:

a hulling part;

a pneumatical sorting part;

a rotary sorting part, said rotary sorting part being constructed with rotatably mounted sorting cylinders having a large number of recesses on an inside peripheral surface thereof and troughs therein;

wherein said pneumatical sorting part communicates with a feeding side of said sorting cylinders through a hulled rice-conveying path and a discharging side of said sorting cylinders communicates with said hulling part through a hull-conveying path, one of said cylinders including a group of said troughs having a finished sorted rice-receiving trough for taking out a portion of sorted rice grains and a rice grain to be resorted-receiving trough for taking out a mixture of husks and rice grains to be resorted, said group of said troughs being installed parallel and adjacent to each other so that said finished sorted rice-receiving trough can be arranged in an upper region along a direction of rotation of said cylinder; an adjusting plate pivoted at its lower end being provided between both said troughs so that its inclined posture can be freely changed; and said finished sorted rice-receiving trough communicating with a taking-out path to a side opening of the device while said rice grain to be resorted-receiving trough communicates with a resorting path within the device.

2. A grain sorter for use in a rotary type rice hulling and sorting device as set forth in claim 1, wherein a rice grain-sorting apparatus is provided between said finished sorted rice-receiving trough and taking-out path opening to the outside of the machine.

3. A grin sorter for use in a rotary type rice hulling and sorting device as set forth in claim 1, in which said rotary sorting part further comprises two steps of sorting cylinders arranged up and down, the primary sorting cylinder arranged in the upper step being provided with said finished sorted rice-receiving trough and said rice grain to be resorted-receiving trough arranged in parallel to each other therein, said finished sorted rice-receiving trough communicating with a taking-out path opening to the outside of the machine, and a mixed rice-feeding path being extended in the secondary sorting cylinder in the lower step from said rice grain to be resorted-receiving trough so as to resort rice grains to be resorted in said secondary sorting cylinder in the lower step.

* * * * *